US007421803B2

(12) United States Patent
Charron

(10) Patent No.: US 7,421,803 B2
(45) Date of Patent: Sep. 9, 2008

(54) DRYER VENTING APPARATUS, TECHNIQUES AND INSTALLATION KIT

(76) Inventor: Philip Charron, 157 Berkeley St., Satellite Beach, FL (US) 32937

( * ) Notice: Subject to any disclaimer, the term of this patent is extended or adjusted under 35 U.S.C. 154(b) by 528 days.

(21) Appl. No.: 10/884,354

(22) Filed: Jul. 2, 2004

(65) Prior Publication Data

US 2005/0005548 A1 Jan. 13, 2005

Related U.S. Application Data

(60) Provisional application No. 60/484,866, filed on Jul. 3, 2003.

(51) Int. Cl.
*F26B 7/00* (2006.01)

(52) U.S. Cl. ..... 34/380; 34/138; 34/235; 285/192

(58) Field of Classification Search ..... 34/90, 34/138, 140, 235, 380; 285/192
See application file for complete search history.

(56) References Cited

U.S. PATENT DOCUMENTS 465,561 A * 12/1891 Hood ..... 454/330
3,856,036 A * 12/1974 Drews et al. ..... 137/216.1
4,121,351 A * 10/1978 Kapke ..... 34/86
4,122,612 A * 10/1978 Mrofchak ..... 34/86
5,584,129 A * 12/1996 Williamson ..... 34/235
6,443,834 B1 * 9/2002 Berger ..... 454/353
6,923,942 B1 * 8/2005 Shirk et al. ..... 422/179
2002/0149201 A1 * 10/2002 Pichotta ..... 285/192

* cited by examiner

*Primary Examiner*—S. Gravini
(74) *Attorney, Agent, or Firm*—Allen Dyer Doppelt Milbrath & Gilchrist

(57) ABSTRACT

Venting through the walls of an interior room of a building to an external environment is facilitated by apparatus and techniques for mounting an in-wall unit for interfacing with the exhaust ports of equipment, such as dryers, using flexible pipe. The in-wall unit connects with venting pipe, such as stovepipe, for connecting to the external environment through an exterior surface, such as a roof. If a roof exhaust is desired, a vent assembly is provided that contains a flap that automatically closes when the exhaust flow terminates, but opens when venting is underway. The flap is removable so that cleanout of path between the in-wall unit and the room exhaust can easily occur.

18 Claims, 10 Drawing Sheets

DRYER VENTING APPARATUS, TECHNIQUES AND INSTALLATION KIT

CROSS REFERENCE TO RELATED APPLICATIONS

This application incorporates by reference in its entirety and claims priority to U.S. Provisional Application 60/484,866, filed Jul. 3, 2003, by inventor Philip Charron.

BACKGROUND OF THE INVENTION

1. Field of the Invention

The invention is directed to equipment venting apparatus and techniques and to an installation kit for installing equipment venting, and particularly in-wall dryer venting.

2. Description of Related Art

Technique for venting automatic clothes dryers through a wall to the external environment are well known in the art. However, use of this technique often requires that a laundry room abut against an external wall. This constrains the design of the home or building in which the dryer is to be placed and, when a laundry room is located internally, that is, does not abut an external wall, a problem arises because one cannot vent a dryer through the adjacent wall to the outside environment. In such circumstances, dryer venting may occur vertically within a wall and vent through a roof to the outside environment.

BRIEF SUMMARY OF THE INVENTION

The purpose of this invention is to provide for easy installation of dryer venting which is particularly suitable for installation in laundry rooms that are internal to a structure. The following figures and descriptions describe how this may be done and illustrate the techniques and components which can be utilized for such installation. In one aspect of the invention the components for such venting may be assembled into a kit.

Although the best mode known to the inventor is set forth herein, it should be apparent that the invention is not limited to the particular embodiments shown.

BRIEF DESCRIPTION OF THE DRAWINGS

The invention is described more particularly hereinafter with reference to the accompanying drawings, in which.

DETAILED DESCRIPTION OF THE INVENTION

Automatic clothes dryers typically contain a heating unit and a rotating drum which tumbles wet clothing in such a way as to expose it to heated air in order to facilitate drying. The heated air represents a particular fire hazard if it were to be vented into a room of the home or other building in which the dryer is located. Other equipment besides dryers may require venting to the external environment. Typically, at the back of an automatic dryer is an exhaust vent, typically a round exhaust pipe to which a flexible venting pipe from the dryer may connect to an external vent. Typically, in the prior art, such external vents were placed through holes in exterior walls to allow the heated air to vent to the external environment.

However, when a laundry room is to be located internal to a building structure in such a way as to not have access to an exterior wall, then other forms of venting must be utilized.

In accordance with the invention, venting of automatic dryers may occur through an interior wall to an external surface, such as a roof. The invention provides a particularly convenient and safe technique for the venting of dryers through an internal wall.

Figure 1:
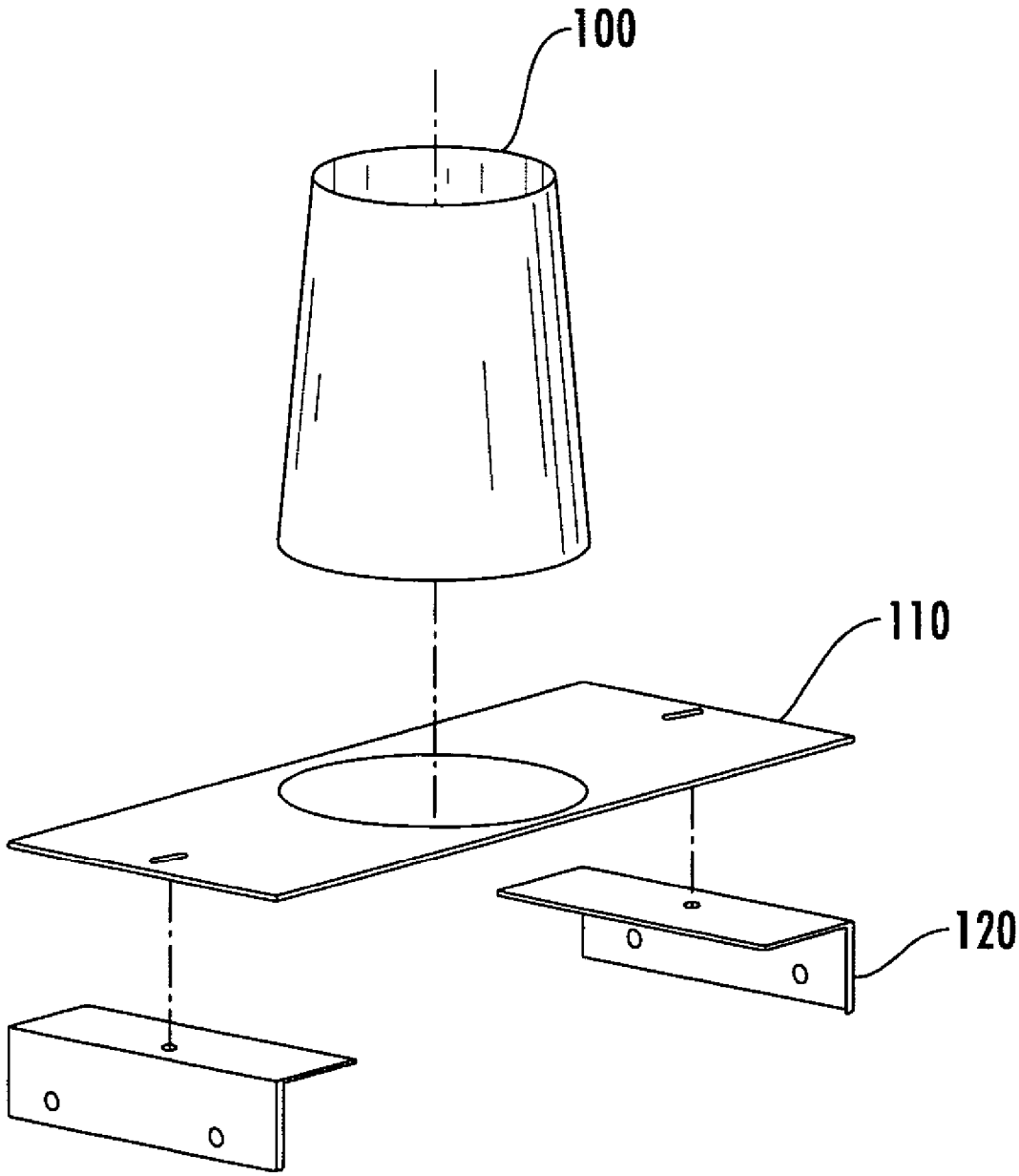
FIG. 1 is an exploded view of an in-wall unit in accordance with one aspect of the invention.

FIG. 1 of the drawing shows an exploded view of an in-wall unit in accordance with one aspect of the invention. A cone shaped unit 100 is attached to of an in-wall unit base 110 and serves to connect at its upper end to, for example, stove pipe which then forms an exhaust channel from the top of the cone shaped pipe to the roof or other external vent. The flared bottom end of the cone 100 received the flexible venting pipe from the dryer as described more hereinafter.

Studs in typical interior walls of a building tend to be formed by two by fours. However, in this case, since the venting diameter may be larger, two by six studs may be utilized for mounting the in-wall unit shown in FIG. 1.

To mount the in-wall unit, in the embodiment shown, two mounting brackets 120 are mounted opposite each other on adjacent two by six studs, approximately thirty inches above the floor. The sides of the mounting brackets having two holes are aligned with a horizontal line previously drawn on the two by six stud using a level. The mounting brackets are then secured to the two by six stud using, preferably, two wood screws. The other mounting bracket is then attached in similar fashion so that the two mounting brackets 120 form a surface upon which the mounting plate 110 can rest. In one implementation, the side of the mounting bracket has a single hole is drilled out, preferably, to receive a number 12 self tapping screw so that the base plate 110 can be secured to the top of the mounting brackets 120. Thus situated, the end wall unit is ready for connection to vent pipe, such as stovepipe, in the upper direction and for connection to the flexible pipe coming from the back of the equipment to the larger end.

Figure 2A:
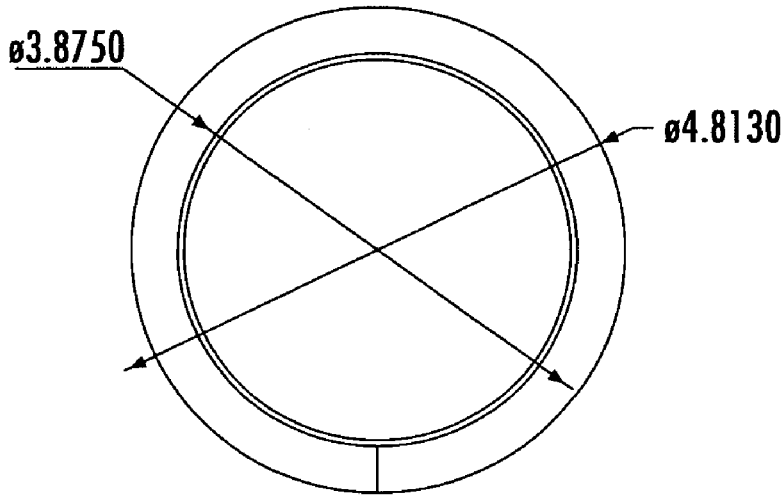
FIGS. 2A and 2B represent a top and side view of a cone shown in FIG. 1.
Figure 2B:
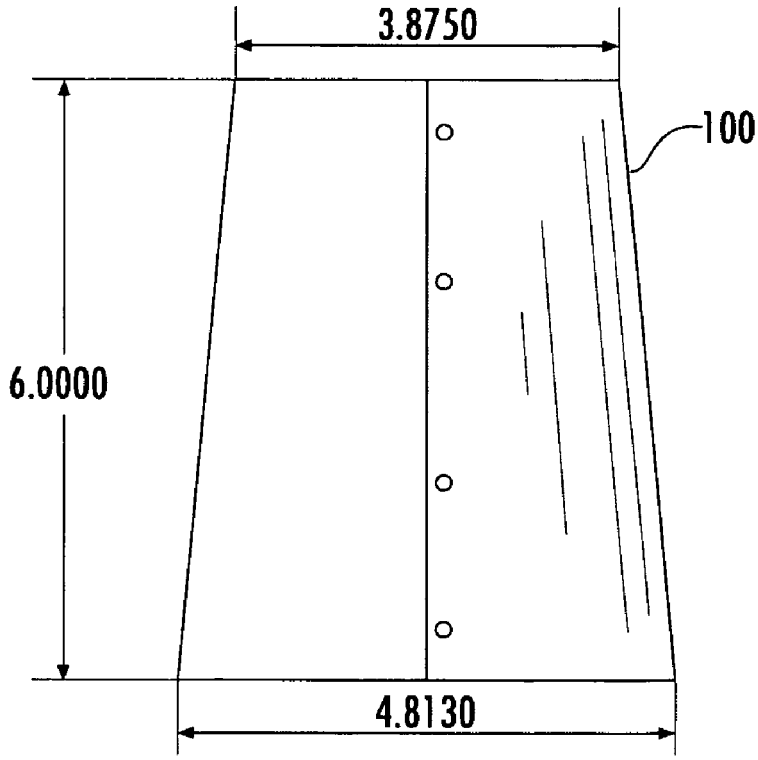

FIGS. 2A and 2B represent a top and side view of the cone shown in FIG. 1. The dimensions are given for an embodiment in which the base of the cone substantially matches the diameter if the hole in the base plate 110. In this configuration, the cone is tack welded three times to the base unit 110 and the seam can be sealed with silicone rubber. Similarly, the seam formed along the rivet line shown in FIG. 2B for the cone element 100 can be sealed with silicone rubber seal.

Alternative ways for connecting the cone shaped element with the base plate will be discussed more hereinafter.

Figure 3A:
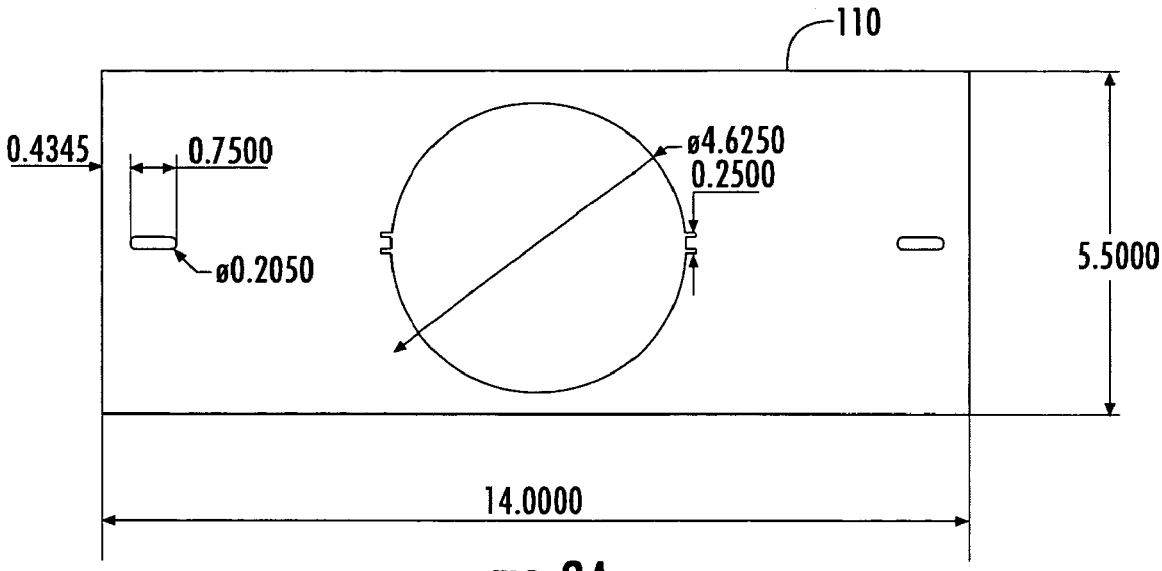
FIGS. 3A, 3B and 3C are respective top, side and end views of an in-wall unit base shown in FIG. 1.
Figure 3B:
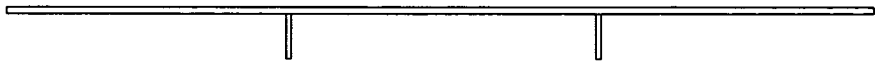
Figure 3C:
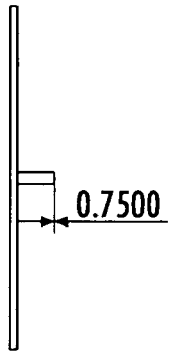

FIGS. 3A, 3B and 3C are respective top, side and end views of an in-wall unit base shown in FIG. 1. The tabs extending down in FIG. 3B from the bottom of the in-wall unit base are used as follows. The flexible pipe from the dryer can be inserted through the hole in the base plate and forced to fit tight against the inside of cone 100 at the point of interference. The flexible pipe from the dryer is then held in place by metallized or metallic tape which connects the flexible pipe to the tabs shown in FIG. 3B, thus holding flexible pipe in position within the cone.

Figure 4A:
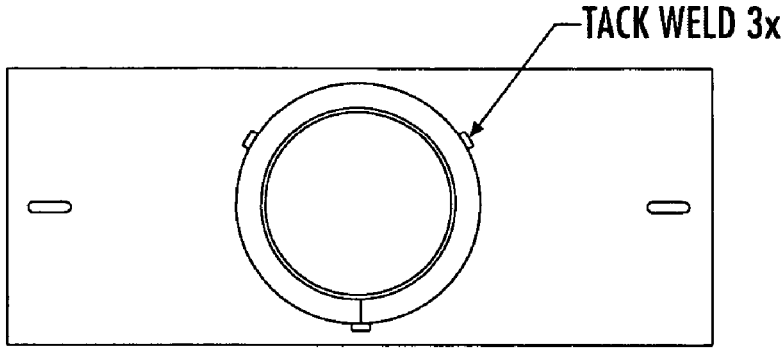
FIGS. 4A, 4B and 4C are respective top, side and end views on an assembled in-wall unit.
Figure 4B:
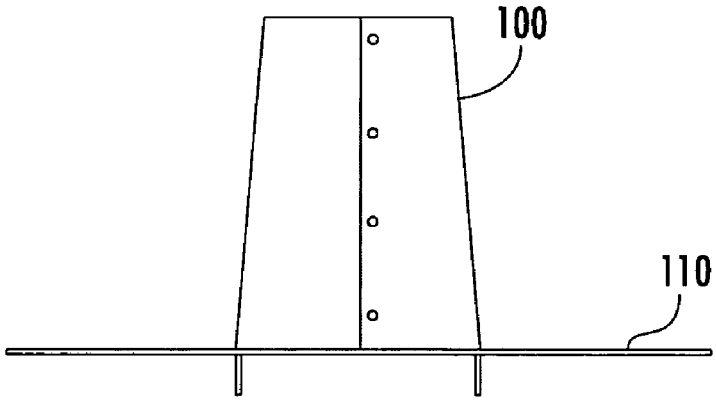
Figure 4C:
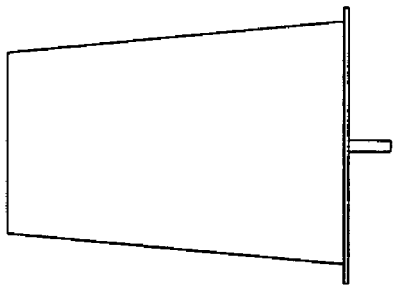

FIGS. 4A, 4B and 4C are respective top, side and end views of an assembled in-wall unit. This unit has not been mounted to the mounting brackets 120. As noted above, the seam between the base plate and the bottom of the cone can be sealed with a silicone rubber seal and the tack welds, hold the conical sections securely in place.

Figure 5A:
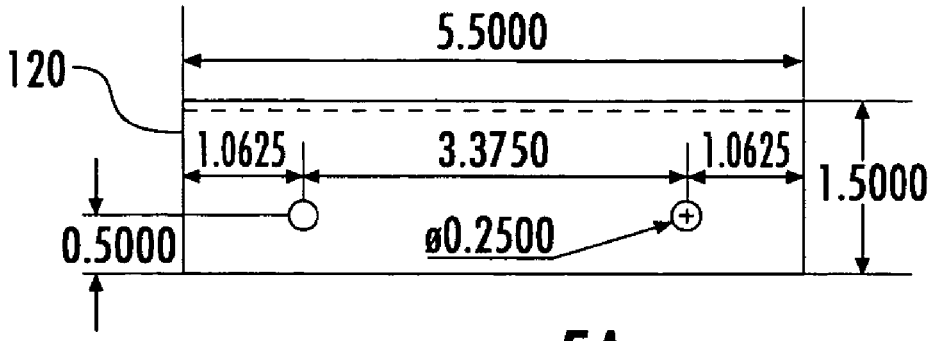
FIGS. 5A, 5B and 5C are respective top, side and end views of mounting bracket shown in FIG. 1.
Figure 5B:
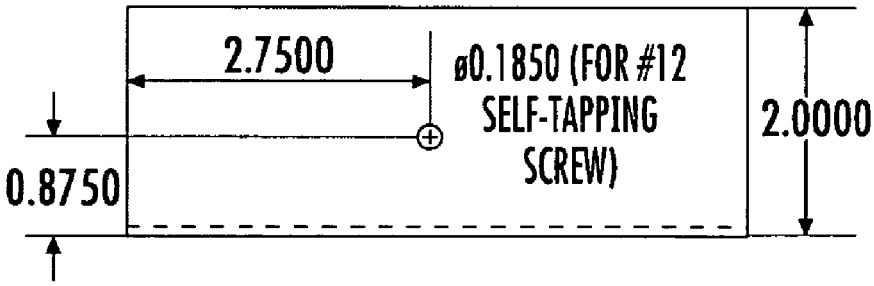
Figure 5C:
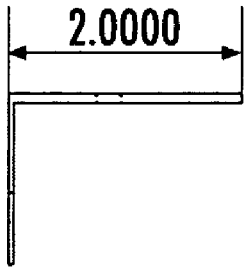

FIGS. 5A, 5B and 5C are respective top, side and end views of the mounting brackets 120. Although this figure gives preferred dimensions, the use of the mounting brackets has been described previously.

Figure 6:
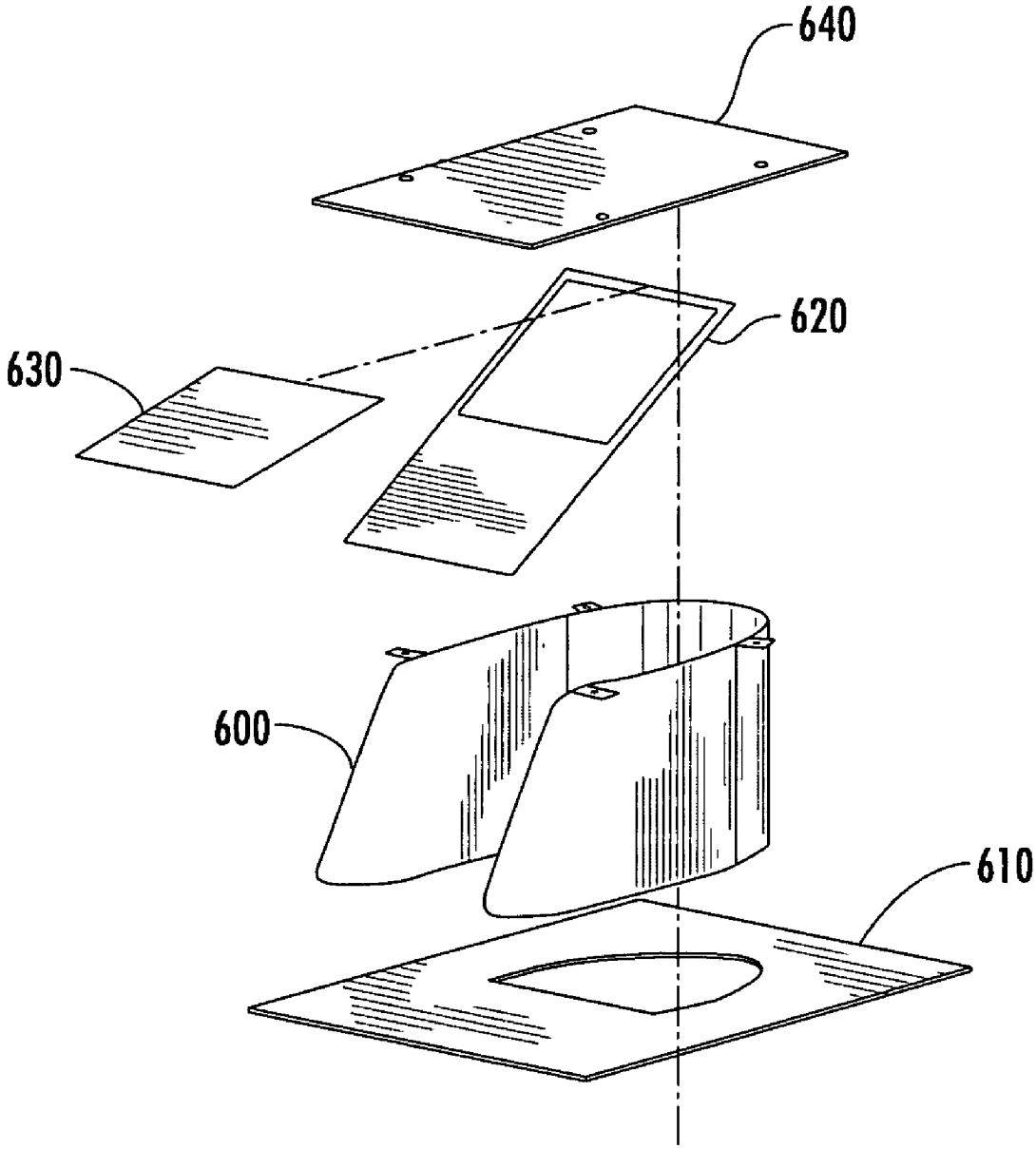
FIG. 6 is an exploded view of a roof vent unit in accordance with one aspect of the invention.
Figure 7:
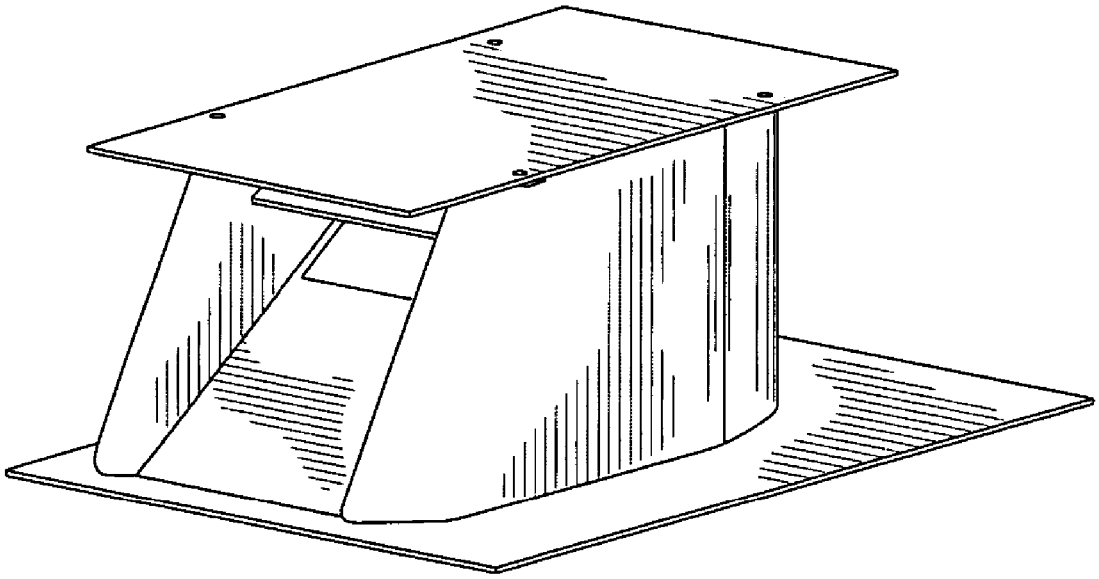
FIG. 7 shows an assembled roof vent unit.

FIG. 6 is an exploded view of a roof vent unit in accordance with one aspect of the invention. The stovepipe connected to the in-wall unit may extend through the roof of the building or may turn 90-degrees and be routed to an exterior wall where it can be vented using prior art techniques. In the event that the stovepipe is to be vented through the roof, the roof vent unit shown in FIG. 6 and FIG. 7 provides preferred way of venting the dryer exhaust to the external environment. As shown in FIGS. 6 and 7 a roof vent body 600, is firmly attached to a roof vent flashing plate 610 and to an exhaust plate 620. An exhaust flap 630 has two tabs which extend beyond the outer extent of the body of the flap and are utilized to mount in recesses in the body 600 in such a way that the flap may open freely when air pressure from the exhaust vent is applied to its under surface. The exhaust flap 630 is held in place by a top cover plate 640 which can be removed in order to permit access to the stovepipe for clean out purposes.

FIG. 7 shows the assembled roof vent unit.

Figure 8A:
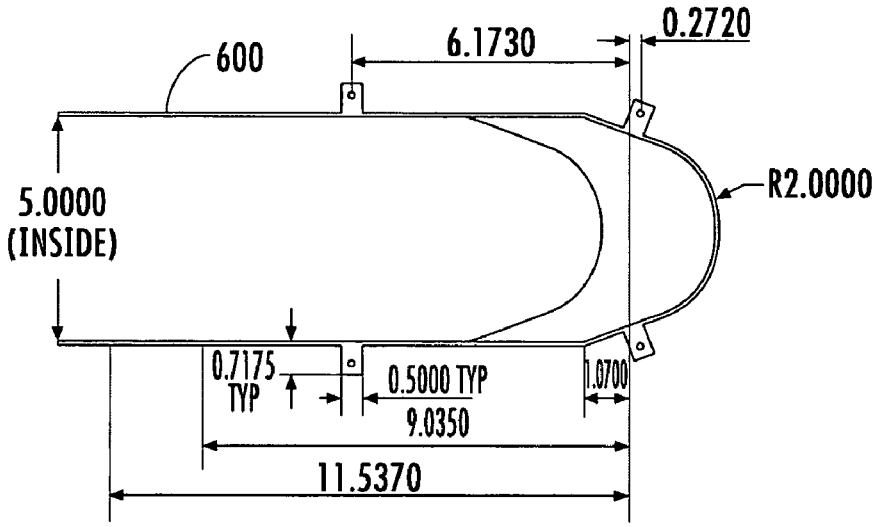
FIGS. 8A and 8B show respective top and side views of a roof vent body in accordance with one aspect of the invention.
Figure 8B:
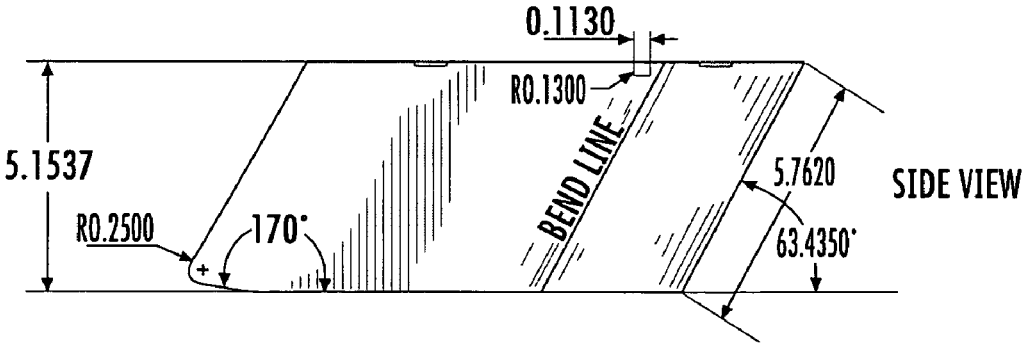

FIGS. 8A and 8B show respective top and side views of a roof vent body in accordance with one aspect of the invention. Note the two notches having a radius of 0.130-inches at the top of the body adjacent the bend line.

Figure 9:
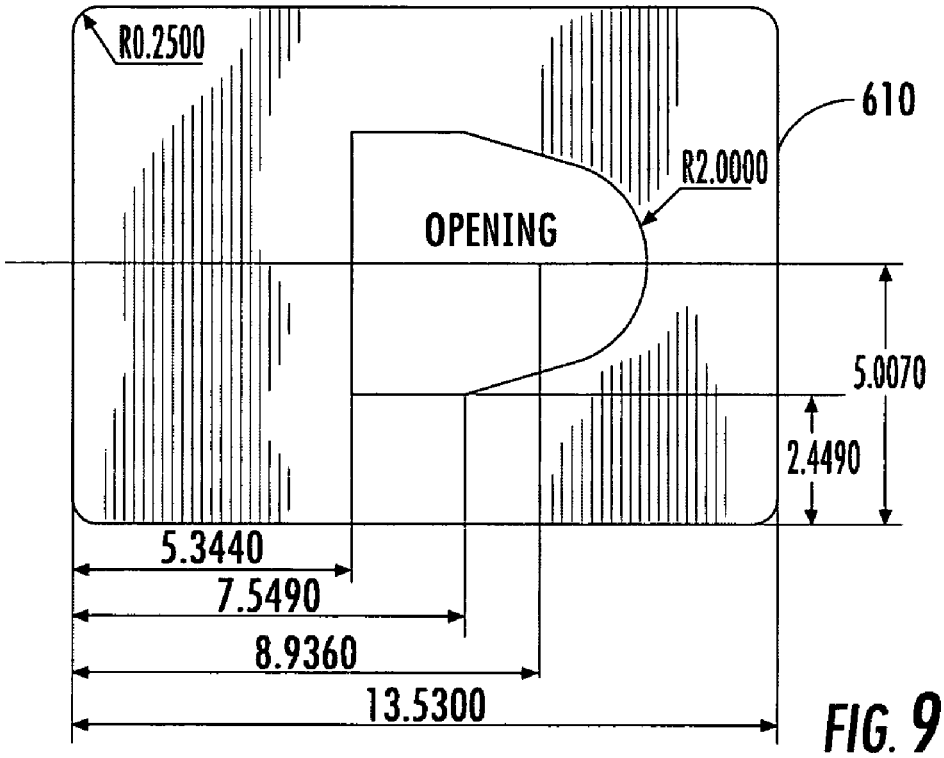
FIG. 9 shows a roof vent flashing plate in accordance with one aspect of the invention.

FIG. 9 shows a roof vent flashing plate in accordance with one aspect of the invention. The flashing plate forms the base of the roof vent unit. The body 600 is attached to the flashing plate, preferably by soldering in a continuous seam around the contact points between the bottom of the body 600 and the flashing plates 610. The alignment of the radius of the hole in the flashing plate and the radius of the curved portion of the body substantially coincide.

Figure 10:
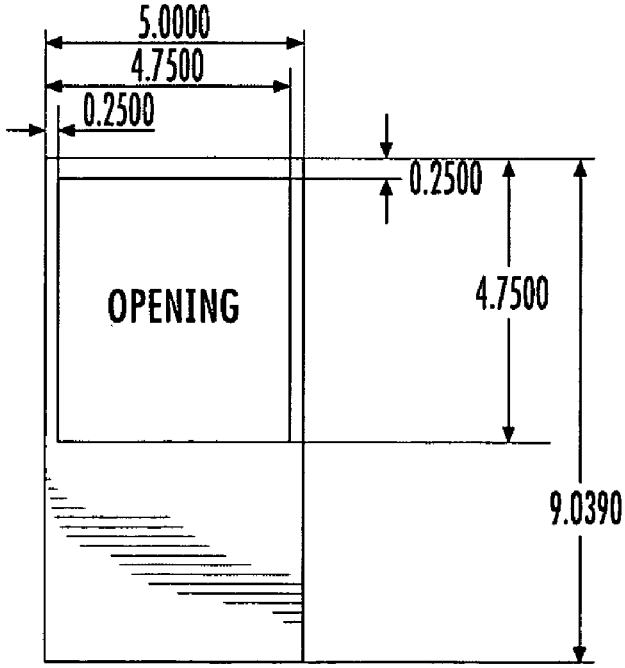
FIG. 10 shows a roof vent exhaust plate in accordance with one aspect of the invention.

FIG. 10 shows a roof vent exhaust plate in accordance with one aspect of the invention. The roof vent flashing plate 620 attaches just behind the 0.130 radius notches found in the body 600. It is mounted to permit the tabs on the exhaust flap 630 to rest in the notches without interference. The exhaust plate is tack soldered along a slope up from the flashing plate and continuously soldered along the bottom connection to the flashing plate.

Figure 11:
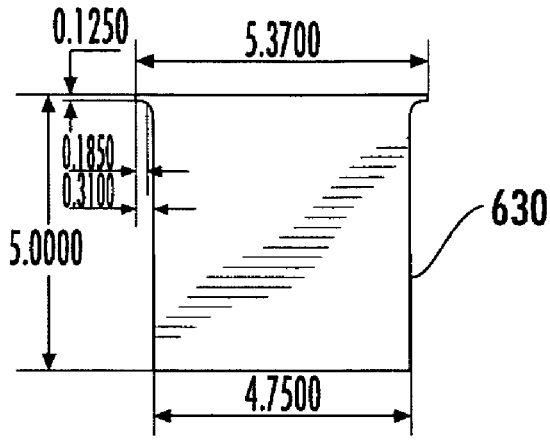
FIG. 11 shows a roof vent exhaust flap in accordance with one aspect of the invention.

FIG. 11 shows a roof vent exhaust flap in accordance with one aspect of the invention. The 0.125 inch tabs at the top of the exhaust flap are placed in the 0.130-inch diameter notches in the top of the roof vent body 600. They sit there freely in such a way as to allow the roof vent flap to open when air from the exhaust of the dryer is applied against its surface. The roof vent exhaust flap 630 is held in place by attaching the top cover plate 640 to the body.

Figure 12:
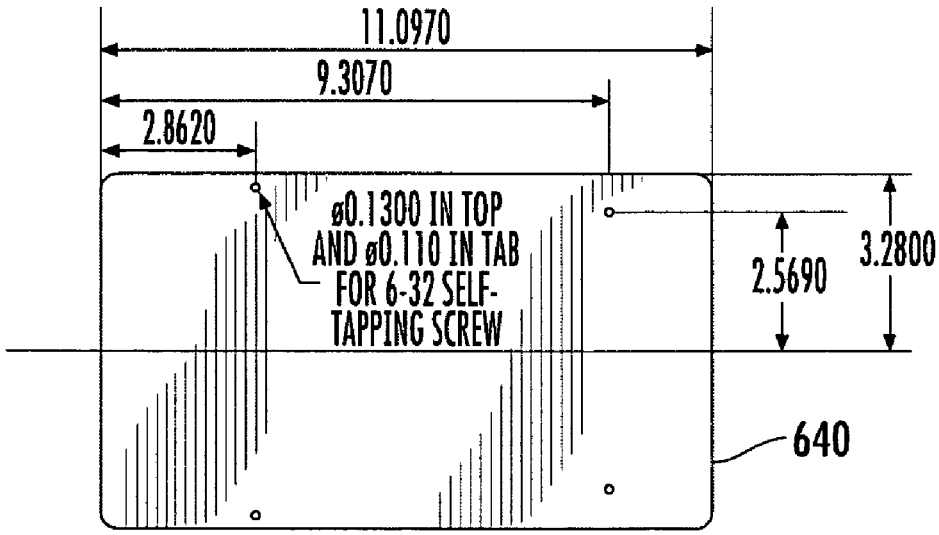
FIG. 12 shows a roof vent top cover plate in accordance with one aspect of the invention.

FIG. 12 shows a roof vent top cover plate in accordance with one aspect of the invention. The roof vent cover plate is designed to be removable to permit the exhaust path to be cleaned out for servicing. The top cover plate is removed, the exhaust flap is removed and the openings are such that a flue brush can be inserted down into the stovepipe to permit cleanout of the exhaust pathway.

Some alternative configurations exist. First, in less durable installations, the in-wall unit base plate may be secured with tape to the mounting brackets 120, rather than using the self-tapping screw. Further, in another embodiment, the conical section can be built with a larger diameter so that it extends only partially through the opening in the in-wall base plate 110. It can then be held in place using tape and the tabs on the base plate 110. In this arrangement, it may be desirable to have additional tabs at the large end of the conical section 100 to permit the taping of the flexible pipe coming from the dryer unit.

The shortest straightest route is best when routing stove pipe to the desired termination point. In some jurisdictions, code requires a maximum of 25 feet from dryer determination point. Each 90-degree tern may subtract 5 feet and each 45-degree turn may subtract 2½ feet. Once the in-wall unit is installed, the wall can be finished with drywall and paint.

The invention described herein is not limited to the specific examples shown, but rather has a broad applicability to communications generally.

What is claimed is:

1. An in-wall unit for providing an interface between equipment needing venting and an exterior environment, comprising:

a. a substantially planar base plate having top and bottom surfaces and a hole of predetermined diameter formed within a medial section of the base plate, and further comprising at least one tab secured on at least one of top and bottom surfaces adjacent the hole and extending out from a surface to which it is secured;

b. a hollow conical section having a larger diameter end and smaller diameter end and attached to said base plate at the larger diameter end and configured to receive flexible pipe from said equipment within the larger diameter end and to connect to a path to said exterior environment at the smaller diameter end, and further comprising tape that secures at least one of the hollow conical section and flexible pipe to the at least one tab for securing at least one of the hollow conical section and flexible pipe to said base plate; and c. opposing brackets for connecting to opposing wall studs for supporting said base plate between said wall studs.

2. The in-wall unit of claim 1, in which said conical section is welded to said base plate.

3. The in-wall unit of claim 1, in which said conical section is attached to said base plate using solder.

4. The in-wall unit of claim 1, in which said base plate is screwed to said brackets.

5. The in-wall unit of claim 1, in which said base plate is taped to said brackets using metallized tape.

6. The in-wall unit of claim 1, in which flexible pipe is extended into said larger end of said conical section and is taped to said conical section using metallized tape.

7. The in-wall unit of claim 1, in which in which said equipment is connected to said flexible pipe.

8. The in-wall unit of claim 1, in which said conical unit is connected to a vent pipe which forms said path to said exterior environment.

9. The in-wall unit of claim 1, in which said vent pipe is connected to a roof vent unit.

10. The unit of claim 9, in which said roof vent unit comprises a flashing plate having an opening through which said stove pipe may pass, connected to a body for receiving a vent pipe through said opening in said flashing plate.

11. The unit of claim 10, in which said body accommodates a vent flap that provides ventilation to the exterior environment when air is exhausted through the vent pipe, but shuts when no air is forced against the vent flap this prevents back draft.

12. The unit of claim 10, in which the vent flap may be removed to provide clean-out access to the vent pipe and in-wall assembly.

13. The unit of claim 12 in which the vent flap is held in place by a removable roof vent unit cover.

14. A kit for installation of in-wall venting for equipment, comprising:

a. a substantially planar base plate having top and bottom surfaces and a hole of predetermined diameter formed within a medial section of the base plate, and further comprising at least one tab secured on at least one of top and bottom surfaces adjacent the hole and extending out from a surface to which it is secured;

b. a metallic hollow conical section having a larger diameter section attached to the base plate at the hole and including a smaller diameter end;

c. flexible pipe for connecting said equipment to said conical section at the larger diameter end;

d. brackets for connecting to opposing wall studs for supporting said base plate between the wall studs; and e. metallized tape for connecting said base plate to said flexible pipe along the at least one tab.

15. A method of installing an in-wall venting unit for connecting equipment to an exhaust path, comprising the steps of:

a. securing opposing mounting bracket to opposing studs of an interior wall;

b. attaching a hollow conical section to an opening in a base plate that has at least one tab extending outward from the surface of the base plate adjacent the opening;

c. securing said base plate to said mounting brackets, so that the axis of the hollow conical section is substantially parallel to said opposing studs; and securing at least one of the hollow conical section and flexible pipe by wrapping tape about the at least one of the hollow conical section and flexible pipe and tabs for securing same together.

16. The method of claim 15 in which the steps of connecting said conical section to said base plate is done by welding.

17. The method of claim 15 in which the steps of connecting said base plate to said mounting brackets is done by one of screwing or by taping with metallized tape.

18. The method of claim 15 in which the steps of securing said mounting brackets to said opposing studs is done by one of nailing or screwing said mounting brackets to said studs.

* * * * *